US005761751A

United States Patent [19]

Morrissey

[11] Patent Number: 5,761,751

[45] Date of Patent: Jun. 9, 1998

[54] PROTECTIVE CURTAIN FOR A SHOWER/TUB

[76] Inventor: Suzanne Morrissey, 1960 N. Lincoln Park West, #2501, Chicago, Ill. 60614

[21] Appl. No.: 671,276

[22] Filed: Jun. 27, 1996

Related U.S. Application Data

[63] Continuation of Ser. No. 491,364, Jun. 30, 1995, abandoned.

[51] Int. Cl.[6] ..... A47K 3/14

[52] U.S. Cl. ..... 4/558; 4/608; 160/DIG. 6

[58] Field of Search ..... 2/250; 4/608, 558, 4/599, 600; 160/330, DIG. 6

[56] References Cited

U.S. PATENT DOCUMENTS

| | | | |
|---|---|---|---|
| D. 22,087 | 12/1892 | Patterson | 160/330 X |
| 477,515 | 6/1892 | Cox et al. | 4/599 |
| 1,500,991 | 7/1924 | Heitler | 4/608 |
| 1,898,233 | 2/1933 | Woods | 4/558 X |
| 2,540,411 | 2/1951 | Wright | 4/599 X |
| 2,593,218 | 4/1952 | Swain | 2/250 |
| 2,613,368 | 10/1952 | Rosenbaum | 4/558 X |
| 3,744,059 | 7/1973 | Hayes | 2/250 |
| 4,126,172 | 11/1978 | Faragher | 4/608 X |

FOREIGN PATENT DOCUMENTS

| | | | |
|---|---|---|---|
| 2055622 | 5/1993 | Canada | 4/599 |
| 0423242 | 1/1947 | Italy | 4/608 |

*Primary Examiner*—Charles E. Phillips
*Attorney, Agent, or Firm*—Leydig, Voit & Mayer Ltd.

[57] ABSTRACT

A protective curtain for a shower/tub. The protective curtain has a flexible body with an inside moisture resistant surface to extend at least partially around a shower/tub and an exposed exterior surface facing oppositely to the inside body surface. Structure is provided on the body for maintaining the protective curtain in an operative position on a support wherein the flexible body drapes downwardly from the support. A design is provided on one of the inside and exterior body surfaces and includes a depiction of at least one of a) an animate object, b) an inanimate object, c) lettering, and d) a scene. A pocket is provided on the one of the inside and exterior surfaces of the body and blended into the depiction of the at least one of the animate object, inanimate object, lettering and scene so that the pocket appears as a part of the at least one of the animate object, inanimate object, lettering, and scene. The pocket is accessible to receive and store discrete objects.

19 Claims, 6 Drawing Sheets

PROTECTIVE CURTAIN FOR A SHOWER/TUB

This is a continuation of application Ser. No. 08/491,364 filed on Jun. 30, 1995, now abandoned.

BACKGROUND OF THE INVENTION

1. Field of the Invention

This invention relates to protective curtains as used to confine water within a shower/tub enclosure and, more particularly, to a protective curtain having incorporated therein the ability to receive and retain discrete objects, such as those typically used in and around the shower/tub enclosure.

2. Background Art

It is common to use a protective curtain on a shower/tub enclosure to selectively block an access opening thereto and thereby confine water to within the enclosure. It is known, for example, to mount a flexible curtain from an elongate bar or rod utilizing hooks at the top of the protective curtain so that the curtain drapes downwardly over the access opening.

Heretofore, it has been common to store various discrete objects used in and around the shower/tub on the ledge of the tub. For example, children's toys are commonly seen strewn around the ledge of the tub, together with various cleaning objects and agents used within and around the enclosure.

Aside from the fact that this accumulation of toys may be unsightly, the toys tend to slip into the tub so that the occupant thereof may step on the toy(s), potentially thereby injuring him/herself.

Since it is desirable to keep the ledge area clean, particularly when young children are bathing, it is common to store toys and other discrete articles at a location away from the enclosure. This represents an inconvenience and accounts for less than efficient use of the space within the enclosure.

Another problem with conventional bathtubs is that they generally have a relatively sterile appearance, particularly to young children. Once the protective curtain is partially or fully closed, the useable space within the enclosure usually has an unadorned appearance which offers little allure to young children, who are by nature reluctant to take baths.

Even when some type of ornamentation that is appealing to children is placed on the shower curtain, repeated viewings thereof may eventually result in a loss of interest by the children.

SUMMARY OF THE INVENTION

In one form of the invention, a protective curtain is provided for a shower/tub. The protective curtain has a flexible body with an inside moisture resistant surface to extend at least partially around a shower/tub and an exposed exterior surface facing oppositely to the inside body surface. Structure is provided on the body for maintaining the protective curtain in an operative position on a support wherein the flexible body drapes downwardly from the support. A design is provided on one of the inside and exterior body surfaces and includes a depiction of at least one of a) an animate object, b) an inanimate object, c) lettering, and d) a scene. A pocket is provided on the one of the inside and exterior surfaces of the body and blended into the depiction of the at least one of the animate object, inanimate object, lettering and scene so that the pocket appears as a part of the at least one of the animate object, inanimate object, lettering, and scene. The pocket is accessible to receive and store discrete objects.

The protective curtain can be utilized to accept discrete objects that are regularly used in and around the shower/tub. By making the protective curtain multi-functional, the user is afforded the convenience of storing objects without significantly obstructing the useable space within the shower/tub.

The pocket can be removably maintained in an operative state through a number of different structures. The pocket could be held in place through a press fit connector, such as hook and loop-type fasteners. This facilitates cleaning and allows interchanging of pockets with different appearances to change the look of the at least one of the animate object, inanimate object, letters, and scene.

In one form, the protective curtain has a top and bottom, with the pocket having an entry opening, and the entry opening is at least partially below a location that is half way between the top and bottom of the protective curtain. In one preferred form, the pocket is accessible to a person, including children, sitting in the tub. To best accomplish this, the pocket may reside entirely beneath the location that is half way between the top and bottom of the protective curtain.

In another form, the protective shower/tub curtain is provided in combination with a shower/tub, with the shower/tub including a body having a peripheral wall. With the protective shower/tub curtain in an operative position, the flexible body drapes downwardly from the support so that the pocket is no more than 2 feet above the peripheral wall of the tub body, to be conveniently reachable by the occupant of the tub.

In one form, a plurality of pockets are provided on the one of the inside and exterior body surfaces.

In one form, the pocket may be defined by at least one flexible sheet that overlies the exterior surface of the flexible body.

The pocket has an entry opening defined between the at least one flexible sheet and the exterior surface of the flexible body, with there being an elastic element on the at least one flexible sheet that normally restricts the size of the entry opening and allows expansion of the entry opening.

With one arrangement, the elastic element draws the flexible sheet towards the exterior surface of the flexible body so that the pocket does not provide an obtrusive protrusion therefrom.

A mesh layer can reside between the at least one flexible sheet and the exterior surface of the flexible body.

Structure can be provided for draining liquid accumulated in the pocket from the pocket.

In one form, there is a design on the other of the inside and exterior body surfaces, with the design including a depiction of at least one of a) an animate object, b) an inanimate object, c) lettering, and d) a scene.

In another form of the invention, a protective curtain is provided for a shower/tub, which protective curtain has a body with an inside moisture resistant surface to extend at least partially around a shower/tub and an exposed exterior surface facing oppositely to the inside body surface. Structure is provided on the body for maintaining the protective curtain in an operative state on a support wherein the body projects downwardly from the support. A design is provided on one of the inside and exterior body surfaces and includes a depiction of at least one of a) an animate object, b) an inanimate object, c) lettering, and d) a scene. A pocket is provided on the one of the inside and exterior surfaces of the body and blended into the depiction of the at least one of the animate object, inanimate object lettering and scene so that the pocket appears as a part of the at least one of the animate object, inanimate object, lettering and scene. The body has a top and bottom, with the pocket residing at least partially beneath the location that is half way between the top and bottom of the body.

The invention further contemplates the combination of a) a tub system including a tub body having a peripheral wall and a support for a protective curtain, and b) a protective curtain with a flexible body having an inside, moisture resistant surface to extend at least partially around the tub body and an exposed exterior surface facing oppositely to the inside body surface. Structure is provided on the flexible body cooperating with the support for maintaining the protective curtain in an operative position wherein the protective curtain drapes downwardly from the support. A pocket is provided on one of the inside and exterior surfaces of the flexible body to receive and store discrete objects. The pocket has an entry opening with there being at least a part of the entry opening that extends no more than two feet above the peripheral wall of the tub body with the protective curtain in the operative position.

DETAILED DESCRIPTION OF THE DRAWINGS

Figure 1:
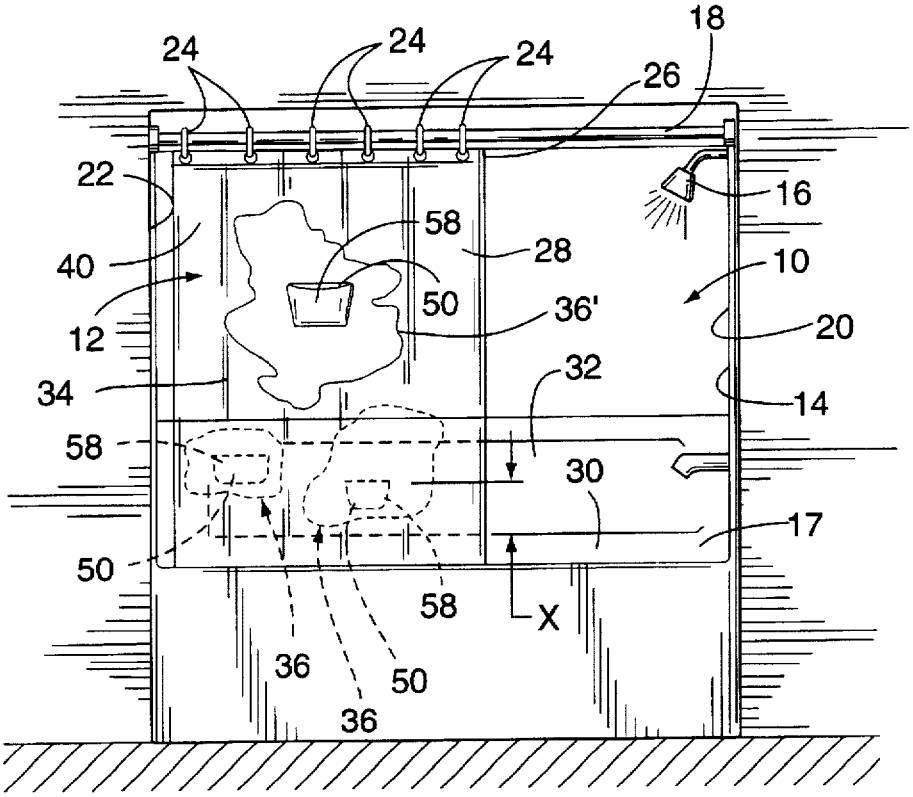
FIG. 1 is a front and top perspective view of a combination shower/tub enclosure with a protective curtain according to the present invention in an operative position thereon.
Figure 2:
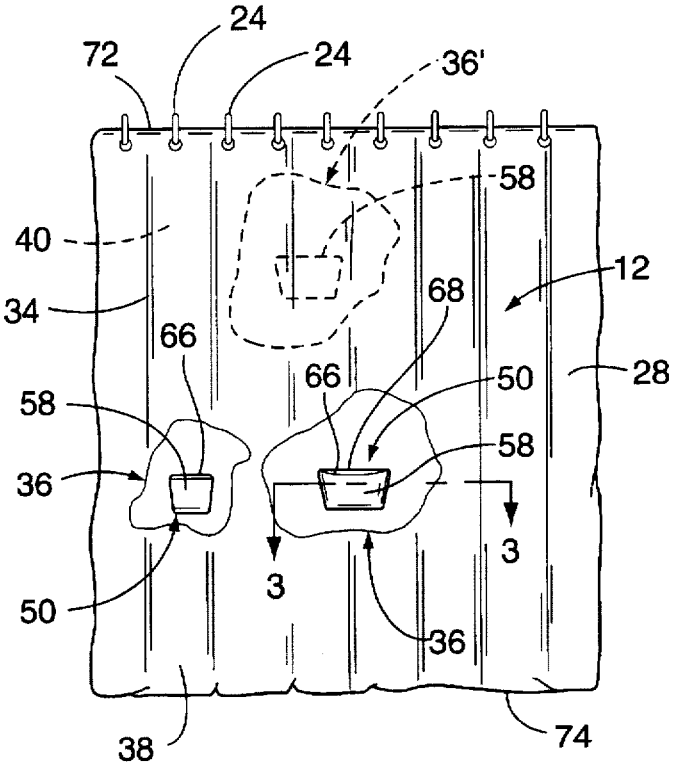
FIG. 2 is an enlarged, elevation view of the inventive protective curtain taken from the side opposite that in FIG. 1.
Figure 3:
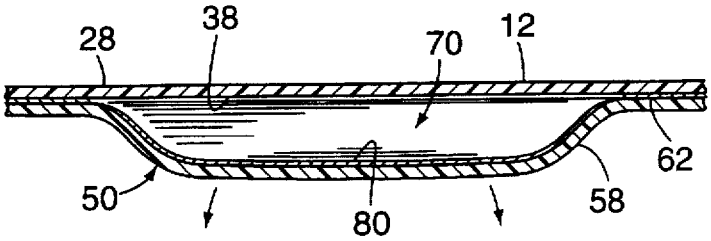
FIG. 3 is an enlarged, cross-sectional view of a pocket on the curtain taken along line 3—3 of FIG. 2.
Figure 4:
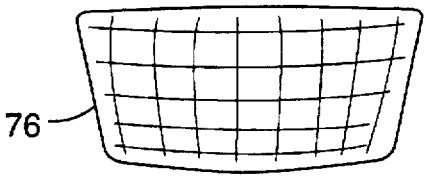
FIG. 4 is an enlarged, front elevation view of a mesh layer that is part of the pocket in FIG. 3.

In FIG. 1, a shower/tub enclosure is shown at 10 having a protective curtain, according to the present invention, at 12, in an operative state. The protective curtain 12 is used to selectively close an access opening 14 at the front of the enclosure 10 to confine moisture discharging from an elevated shower head 16 within the enclosure 10 and moisture that might be splashed outwardly from a tub 17.

A support bar 18 spans facing side walls 20, 22 on the enclosure 10 and maintains the protective curtain 12 in the operative position of FIG. 1. To accomplish this, a plurality of hooks 24 extend around the support bar 18 and attach to the upper end 26 of the body 28 of the curtain 12 to allow the body 28 to drape downwardly across the access opening 14, and preferably downwardly beyond the upper ledge 30 of a peripheral wall 32 on the tub 17.

The body 28 of the protective curtain 12 is made from a flexible, moisture resistant material that can be readily reconfigured and folded. Suitable materials for this purpose are a polyester cotton blend, 100% polyester, Teflon® material, vinyl, and other materials that will confine moisture without damage thereto. A separate liner could be used with the body 28.

With the curtain 12 in the operative position, the curtain 12 can be stretched across the access opening 14 by sliding the hooks 24 along the support bar 18. To gain access to the shower/tub enclosure 10, the user slides the protective curtain 12 to one side of the enclosure 10, in the process sliding the hooks 24 along the support bar 18. The curtain 12 accumulates on the one side and forms a plurality of vertically extending pleats 34.

Figure 7:
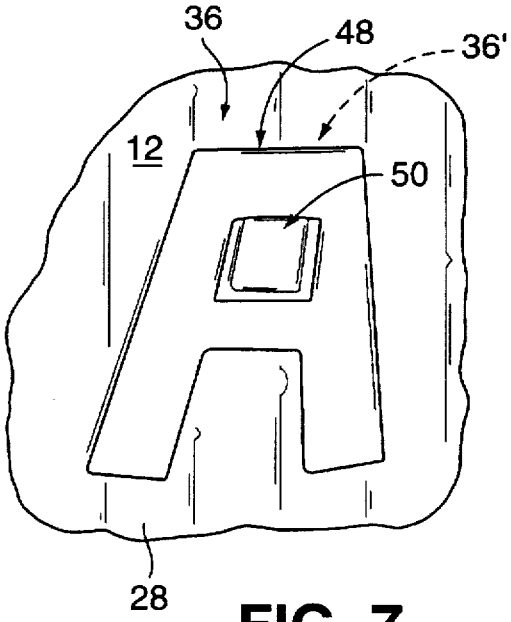
FIG. 7 is a view as in FIGS. 5 and 6 showing a letter/logo with a pocket, according to the present invention, blended into the design of the letter/logo so as to appear as a part thereof.
Figure 8:
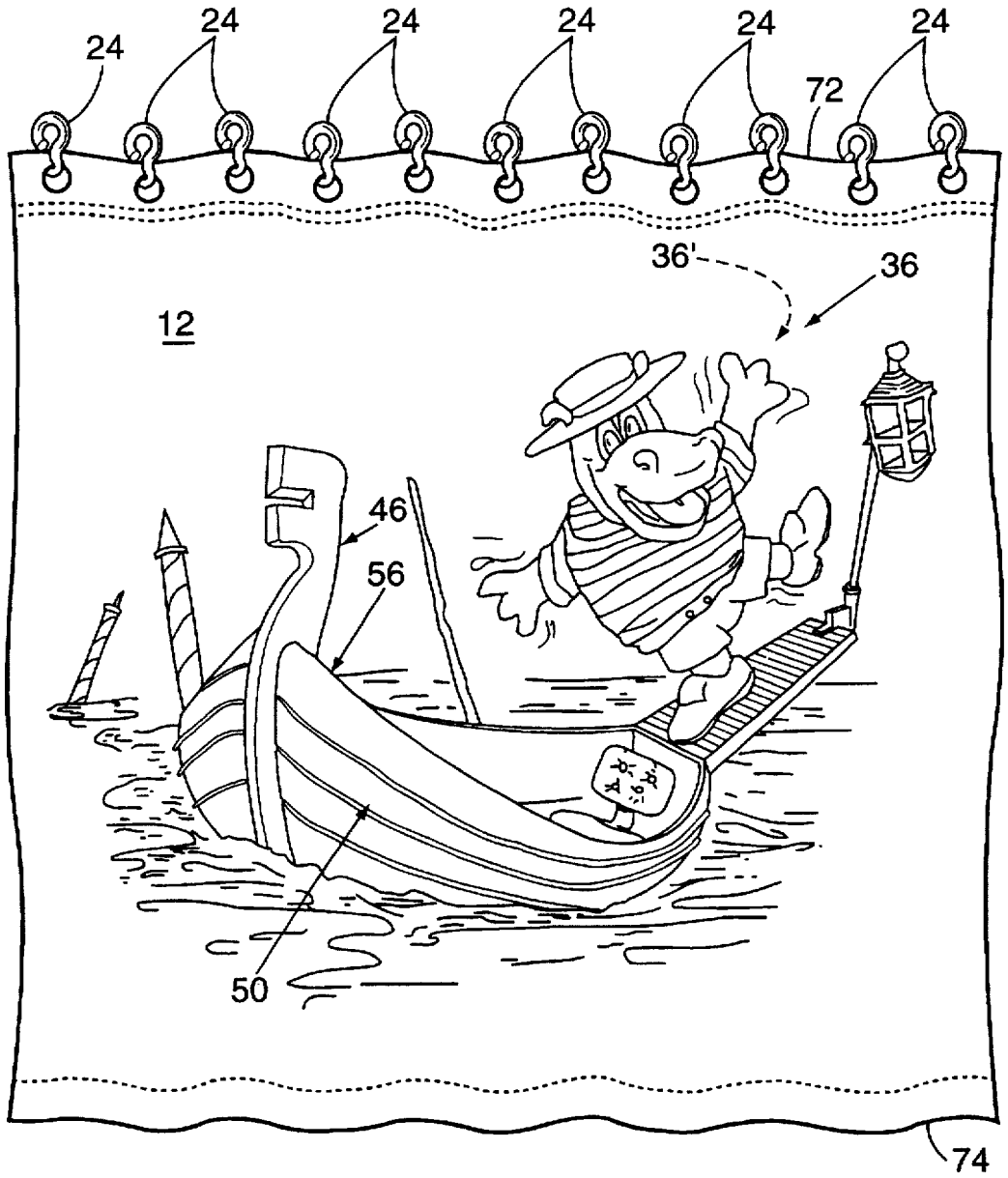
FIG. 8 is an elevation view of a pocket, according to the present invention, incorporated into a scene on the protective curtain.

As seen in FIGS. 1–5, the inventive curtain 12 has a design 36 on the inside surface 38 of the body 28 and a design 36' on the exterior surface 40 of the body 28. The particular design 36, 36' can vary considerably from the depiction of an animate object, as shown at 42 in FIG. 9 and 44 in FIG. 10, in this case respectively a dog and a flock of pelicans, to an inanimate object, such as a boat 46 that is part of a scene as shown in FIG. 8, to lettering or a logo, as shown at 48 in FIG. 7. The various designs shown in FIGS. 7–10 are but exemplary of the many designs that are contemplated by the invention. The designs, 36, 36' could be on one of the surfaces 38, 40, or both of the surfaces 38, 40. The designs on the inside surface 38 and exterior surface 40 can be different and more preferably are coordinated to carry a theme from the outside to the inside of the shower/tub enclosure 10.

In one aspect of the invention, a pocket 50, shown in FIGS. 1–5, is provided on the body surface 38, 40 on which the design 36, 36' is provided. The pocket 50 is blended into the design 36, 36' so that the pocket 50 appears as a part of the animate object, inanimate object, lettering, scene, etc. that is part of the design 36, 36'. For example, in FIG. 10, one pocket 50 is shown in association with each of the pelicans 44. The pocket 50 is configured so that it conforms to the shape of the beak 52 for each pelican 44 so that it blends in as part of the scene. That is, it does not significantly stand out or detract from the design 36, 36' and at the same time contributes a functional feature to the curtain 12.

Figure 9:
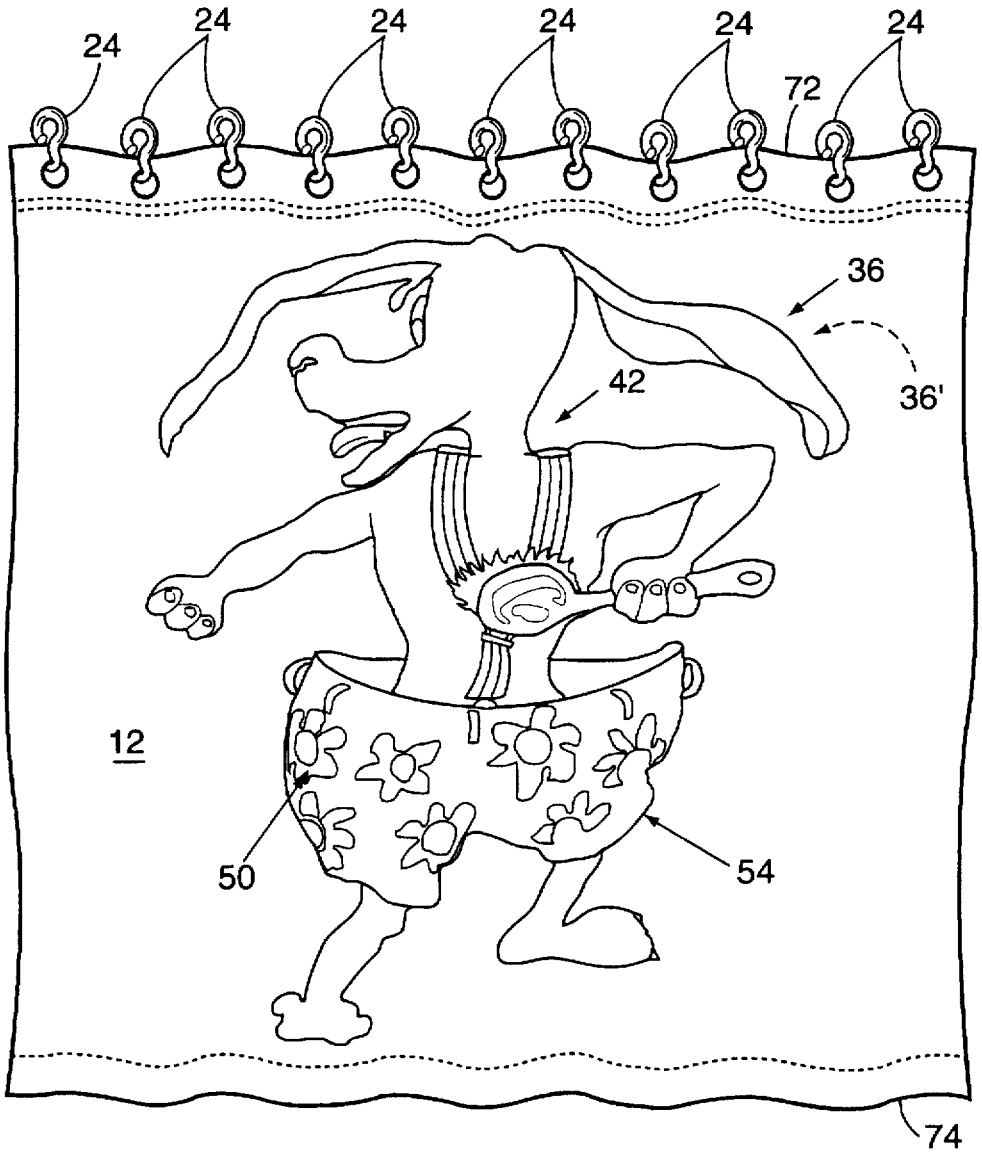
FIG. 9 is a view as in FIG. 8 showing multiple pockets, according to the present invention, incorporated into a design that is a depiction of a dog.

In FIG. 9, the pocket 50 is configured and located to correspond to a pair of shorts 54 on the dog 42. In FIG. 8, the pocket 50 is placed to correspond to one side wall on the hull of a boat 56 in the scene. In FIG. 7, the pocket 50 is placed in a void in the lettering/logo 48.

Figure 6:
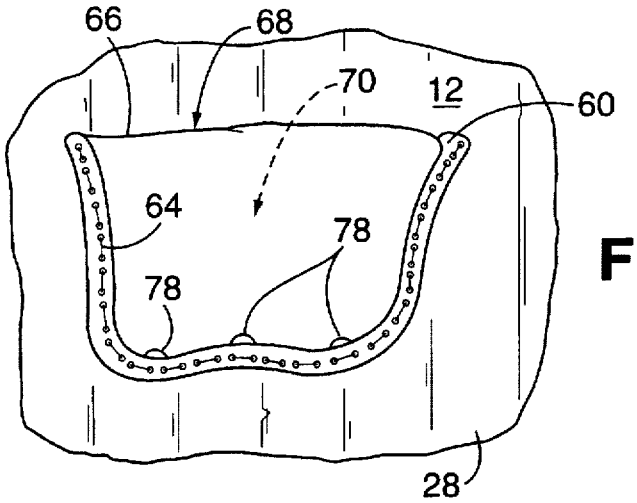
FIG. 6 is a view as in FIG. 5 of a modified form of pocket.

In one form, each pocket 50 is defined by a flexible sheet 58 that overlies the inside surface 38 of the body 28 of the protective curtain 12. The flexible sheet 50 may be a vinyl material, that is clear or translucent to permit viewing of the contents of the pocket 50, and may be colored to coordinate with the design 36, 36'. The flexible sheet 58 has a flap 60 at the periphery thereof that is affixed to the body 28 of the protective curtain 12. In one form, an adhesive layer 62 (FIG. 3) can be used to effect this connection. In FIG. 6, a line of stitching 64 is shown to connect the flap 60 to the body 28. Other suitable means are well known to those skilled in the art, such as by heat or chemical fusion, etc.

With the flap 60 connected to the body 28, the top edge 66 of the sheet 58 remains unconnected to the body 28 so that an entry opening 68 is provided between the top edge 66 and the inside surface 38 of the body 28. Between the flexible sheet 58 and the body 28, a receptacle 70 is provided for discrete objects such as toys, cleaning materials, etc. that are used regularly within the enclosure 10 and in the vicinity thereof The pockets 50 thus make the protective curtain 12 multi-functional as both a moisture shield for the enclosure 10 and as a storage device.

Figure 10:
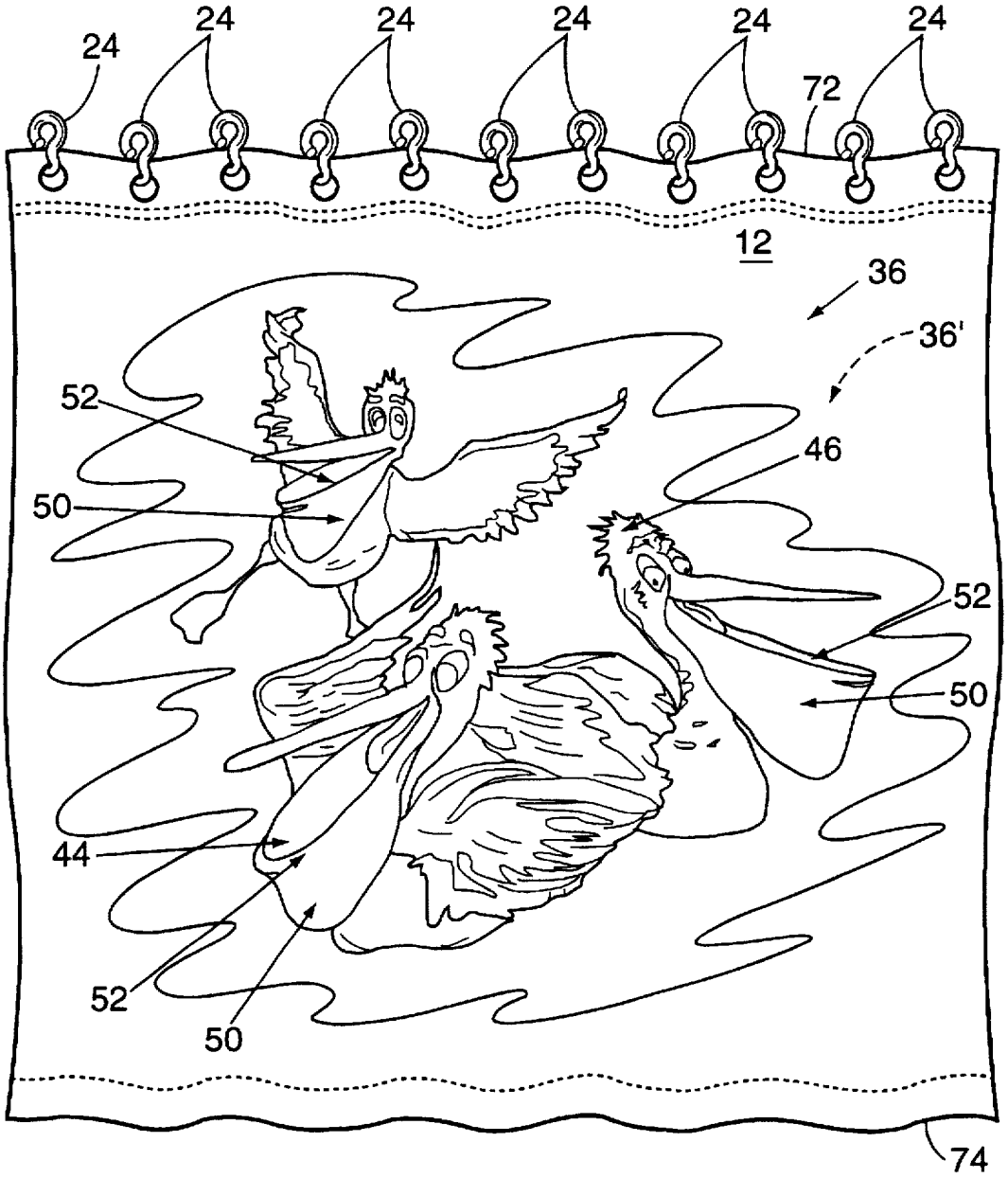
FIG. 10 is a view as in FIG. 9 with a modified form of design including multiple pockets, according to the present invention, incorporated into a design that depicts a flock of pelicans.

The inventive curtain 12 is particularly desirable as a bath aid for young children. The designs 36, 36', such as those shown in FIGS. 8–10, are highly appealing to young children. Ideally, the pockets 50 are located on the inside surface 38 of the body 28 so that at least part of the entry opening 68 resides beneath a location that is half way between the top edge 72 of the body 28 and the bottom edge 74 of the body 28. With the pocket 50 on the inside surface 38 of the body 28, and the protective curtain 12 in the operative position of FIG. 1, it is preferred that the distance X in FIG. 1 between the upper ledge 30 of the tub 17 and the entry opening 68 be no more than two feet and preferably no more than one foot. The pockets 50 in this location provide a convenient access to young children seated in the tub 17. Toys which would regularly be placed around the ledge 30 and clutter the enclosure 10 can be conveniently stored in the pockets 50 and readily accessed by the occupant of the tub 17.

Another aspect of the invention is the provision of a flexible mesh layer 76 that is captive between the flexible sheet 58 and the body 12. The mesh layer 76 provides a support for articles within the receptacle 70, while permitting moisture to pass therethrough so that the moisture is not held captive against the objects.

Any moisture that would accumulate in the receptacle 70 is allowed to discharge through drain openings 78 at the bottom of the pocket 50.

Another aspect of the invention is the provision of an elastic element 80 on the flexible sheet 58. The elastic 80 tends to bunch up the flexible sheet 58 to thereby reduce the width of the flexible sheet 58 so as to effectively diminish the size of the entry opening 68. By drawing out on the top edge 66 of the flexible sheet 58, the elastic 80 is stretched, unbunching the flexible sheet 58 to allow the entry opening 68 to effectively enlarge.

Figure 5:
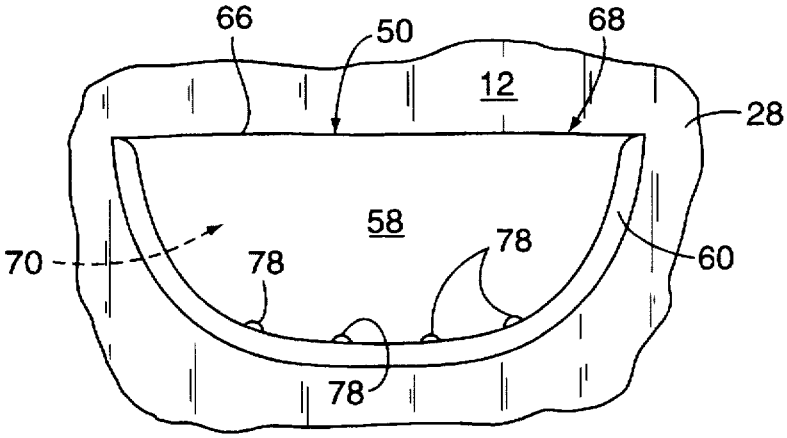
FIG. 5 is an enlarged, fragmentary, elevation view of a portion of the inventive curtain and a pocket, according to the present invention, thereon.
Figure 11:
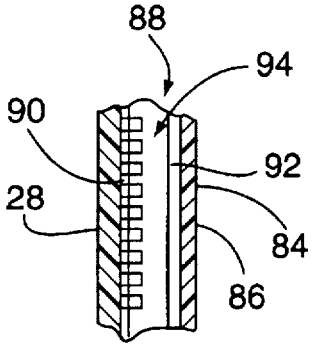
FIG. 11 is a fragmentary, cross-sectional view of a releasable connection between a pocket and curtain, according to the present invention.

In another aspect of the invention, as shown in FIG. 11, a sheet 84, corresponding to the sheet 58 in FIG. 5, can be releasably maintained in an operative state on the curtain body 28. The sheet 84 can have the same configuration as the sheet 58, with the outtuned flap 86, corresponding to the flap 60, being adhered to the body 28 through a means at 88. The means 88 could be a fastener of the type using a hook part 90 and a loop part 92 that can be pressed against each other and pulled apart to repeatedly secure the flap 86 to the body 28 and remove the flap 86 therefrom. A suitable fastener for this purpose is sold commercially under the registered trademark VELCRO®.

The VELCRO®-type fastener, in addition to facilitating assembly and disassembly of the flap 86, allows drainage from the pocket 94 defined between the sheet 84 and body 28. That is, water that would accumulate between the sheet 84 and body 28, can migrate through the means 88. This avoids the formation of mildew.

By allowing the sheet 84 to be removed, washing of the entire curtain is facilitated. Additionally, the sheet 84 can be replaced by another sheet (not shown) which might have a different appearance so that the overall appearance of the curtain 12 can be changed.

More significantly, the sheet 84 will break away if pulled upon, as when a child falls against, or pulls on, the curtain 12. This minimizes the likelihood of injury, as when a child is for any period of time, unattended in the shower/tub enclosure 10. The sheet 84 could be removed ahead of time if a child is to be unattended.

Figure 12:
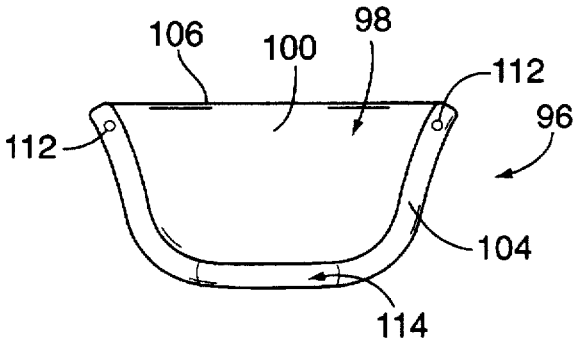
FIG. 12 is a front elevation view of a modified form of removable pocket, according to the present invention.
Figure 13:
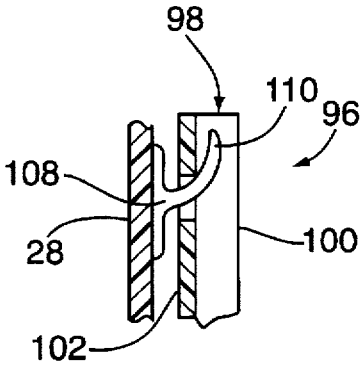
FIG. 13 is an enlarged, fragmentary, cross-sectional view of one connecting point between the pocket of FIG. 12 and curtain.

In FIGS. 12 and 13, a modified system for defining a removable pocket is shown at 96. The system 96 includes a self-contained pocket 98 defined by an overlying sheet 100 and an underlying sheet 102 which are fused so as to define a peripheral flap 104 interrupted at a top, entry opening 106.

In this case, a pair of hooks 108 (one shown) are suitably attached to the curtain body 28. Each hook free end 110 is extendable into an opening 112 in the flap 104. The pocket 98 can be easily assembled onto the hooks and removed therefrom.

An optional additional fastener 114, such as the hook and loop fastener of FIG. 11, can be used at one or more locations on the flap 104 to maintain the flap 104 against the body 28.

The system shown in FIGS. 12 and 13 has the same versatility in that it allows the pocket 98 to be conveniently placed on and removed from the curtain body 28.

A similarly configured pocket (not shown) could be substituted for the pocket 98 to vary the appearance of the curtain 12.

The foregoing disclosure of specific embodiments is intended to be illustrative of the broad concepts comprehended by the invention.

I claim:

1. A protective curtain for a shower/tub, said protective curtain comprising:

a flexible body having an inside moisture resistant surface to extend at least partially around a shower/tub and an exposed exterior surface facing oppositely to the inside body surface;

means on the body for maintaining the protective curtain in an operative position on a support wherein the flexible body drapes downwardly from the support;

a design on one of the inside and exterior body surfaces and including a depiction of at least one of a) an animate object, b) an inanimate object, c) lettering, and d) a scene;

a pocket on the one of the inside and exterior surfaces of the body and blended into the depiction of the at least one of the animate object, inanimate object, lettering and scene so that the pocket appears as a part of the at least one of the animate object, inanimate object, lettering and scene, said pocket being accessible to receive and store discrete objects.

2. The protective shower/tub curtain according to claim 1 wherein the protective curtain has a top and bottom, the pocket has an entry opening and the entry opening is at least partially below a location that is half way between the top and bottom of the protective curtain.

3. The protective shower/tub curtain according to claim 2 wherein the pocket resides entirely beneath the location that is half way between the top and bottom of the protective curtain.

4. The protective shower/tub curtain according to claim 1 wherein the pocket is defined by at least one flexible sheet that overlies the exterior surface of the body.

5. The protective shower/tub curtain according to claim 4 wherein the pocket has an entry opening defined between the at least one flexible sheet and the exterior surface of the body, there being an elastic element on the at least one flexible sheet that normally restricts the size of the entry opening and allows expansion of the entry opening.

6. The protective shower/tub curtain according to claim 5 wherein there is a mesh layer residing between the at least one flexible sheet and the exterior surface of the body.

7. The protective shower/tub curtain according to claim 6 including means for draining liquid accumulated in the pocket from the pocket.

8. The protective shower/tub curtain according to claim 1 wherein there is a design on the other of the inside and exterior body surfaces including a depiction of at least one of a) an animate object, b) an inanimate object, c) lettering, and d) a scene.

9. The protective shower/tub curtain according to claim 1 wherein there are a plurality of pockets on the one of the inside and exterior body surfaces.

10. The protective shower/tub curtain according to claim 1 in combination with a shower/tub and a support for the protective shower/tub curtain wherein the shower/tub includes a tub body having a peripheral wall and with the protective shower/tub curtain in the operative position the body drapes downwardly from the support so that the pocket is no more than two feet above the peripheral wall of the tub body.

11. A protective curtain for a shower/tub, said protective curtain comprising:

a body having an inside moisture resistant surface to extend at least partially around a shower/tub and an exposed exterior surface facing oppositely to the inside body surface;

means on the body for maintaining the protective curtain in an operative state on a support wherein the body projects downwardly from the support;

a design on one of the inside and exterior body surfaces and including a depiction of at least one of a) an animate object, b) an inanimate object, c) lettering, and d) a scene;

a pocket on the one of the inside and exterior surfaces of the body and blended into the depiction of the at least one of the animate object, inanimate object, lettering and scene so that the pocket appears as a part of the at least one of the animate object, inanimate object, lettering and scene, wherein the body has a top and bottom and the pocket resides at least partially beneath a location that is half way between the top and bottom of the body.

12. The protective shower/tub curtain according to claim 11 wherein the pocket resides entirely beneath the location that is half way between the top and bottom of the body.

13. The protective shower/tub curtain according to claim 11 wherein the body comprises a flexible, foldable material.

14. The protective shower/tub curtain according to claim 13 wherein the pocket is defined by at least one flexible sheet that overlies the exterior surface of the body.

15. The protective shower/tub curtain according to claim 13 wherein the pocket has an entry opening that is at least partially beneath the location that is half way between the top and bottom of the body.

16. The protective shower/tub curtain according to claim 15 wherein the pocket is defined by at least one flexible sheet that overlies the exterior surface of the body and there is an elastic element on the at least one flexible sheet that normally restricts the size of the entry opening and allows expansion of the entry opening.

17. The protective shower/tub curtain according to claim 16 wherein there is a mesh layer residing between the at least one flexible sheet and the exterior surface of the body and means for draining liquid accumulated in the pocket from the pocket.

18. The protective shower/tub curtain according to claim 17 wherein there are a plurality of pockets on the one of the inside and exterior body surfaces.

19. The protective shower/tub curtain according to claim 17 wherein there is a design on the other of the inside and exterior body surfaces including a depiction of at least one of a) an animate object b) an inanimate object, c) lettering, and d) a scene.

* * * * *